US008096306B2

(12) United States Patent
Malvar et al.

(10) Patent No.: US 8,096,306 B2
(45) Date of Patent: Jan. 17, 2012

(54) MOLDED PLASTIC MASCARA BRUSH

(75) Inventors: Michael Malvar, Oceanside, NY (US); Frank A. Riess, Wheatley Heights, NY (US); Volker Schrepf, East Islip, NY (US)

(73) Assignee: Albea Services, Gennevilliers (FR)

( * ) Notice: Subject to any disclaimer, the term of this patent is extended or adjusted under 35 U.S.C. 154(b) by 763 days.

(21) Appl. No.: 11/825,345

(22) Filed: Jul. 5, 2007

(65) Prior Publication Data

US 2008/0011317 A1 Jan. 17, 2008

Related U.S. Application Data

(60) Provisional application No. 60/830,719, filed on Jul. 12, 2006, provisional application No. 60/845,098, filed on Sep. 15, 2006.

(51) Int. Cl.
*A45D 40/26* (2006.01)

(52) U.S. Cl. ..... 132/218

(58) Field of Classification Search ..... 132/320, 132/318, 216–218; 15/187, 188, 209.1, 201.1, 15/234, 169, 173, 199; 401/268; 300/19, 300/11

See application file for complete search history.

(56) References Cited

U.S. PATENT DOCUMENTS

| | | | | | |
|---|---|---|---|---|---|
| 1,466,723 | A * | 9/1923 | Izawa | 15/193 |
| 1,796,001 | A * | 3/1931 | Church | 15/167.1 |
| 2,303,660 | A * | 12/1942 | Schickel | 15/114 |
| 4,422,986 | A * | 12/1983 | Cole | 264/39 |
| 5,137,038 | A * | 8/1992 | Kingsford | 132/218 |
| 5,150,495 | A * | 9/1992 | Discko et al. | 15/167.1 |
| 5,161,554 | A * | 11/1992 | Fitjer | 132/218 |
| 5,479,951 | A * | 1/1996 | Denebeim | 132/265 |
| 2005/0081874 | A1 * | 4/2005 | Mathiez | 132/218 |
| 2005/0133056 | A1 * | 6/2005 | Montoli | 132/218 |

* cited by examiner

*Primary Examiner* — Todd Manahan
*Assistant Examiner* — Brianne O'Neill
(74) *Attorney, Agent, or Firm* — Cooper & Dunham LLP

(57) ABSTRACT

A molded plastic mascara brush having an elongated flexible core with multiple bristles projecting radially therefrom, and a shape-sustaining wire extending longitudinally through the core. The wire may be bendable, enabling a desired curvature to be imparted to the brush. Additionally or alternatively, with the core and bristles molded integrally and at least some bristles disposed in rows extending lengthwise of the core, bristles may be spaced around the core at unequal angular distances, and/or bristles of at least one row may decrease progressively in length, and/or bristles may be disposed in tandem zones that differ from each other in bristle density, and/or some bristles may be disposed in rows and others of smaller diameter disposed in clusters.

8 Claims, 10 Drawing Sheets

MOLDED PLASTIC MASCARA BRUSH

CROSS REFERENCE TO RELATED APPLICATIONS

This application claims the benefit, under 35 U.S.C. §119 (e), of U.S. provisional patent applications No. 60/830,719, filed Jul. 12, 2006, and No. 60/845,098, filed Sep. 15, 2006, the entire disclosures of both of which are incorporated herein by this reference.

BACKGROUND OF THE INVENTION

This invention relates to molded plastic brushes for applying mascara or the like to a user's eyelashes.

Mascara brushes of the type commonly referred to as "twisted-in-wire" brushes are well known and widely used in the cosmetics industry. A twisted-in-wire mascara brush has an axially elongated twisted wire core with a multiplicity of fibers such as bristles clamped at their midpoints in the core and extending radially outwardly therefrom; the core is constituted of two lengths of wire, which may be initially separate or may be opposed legs of a single U-shaped wire, twisted together into a helix to hold the bristles between them. Typically, the bristles are more or less uniformly distributed for at least most of the length of the brush, and the overall shape of the brush (i.e., the notional envelope defined by the tips of the bristles) has a rectilinear axis and a simple circular cross-section, being cylindrical, frustoconical, or a tandem arrangement of proximal cylindrical and distal frustoconical portions.

Although the combination of a twisted wire core and a radiating array of bristles clamped in the core provides an acceptable brush structure for uses exemplified by the application of mascara, twisted-in-wire mascara brushes have certain disadvantages. They are relatively costly, and there are only a limited number of suppliers. Moreover, a conventional twisted-wire brush offers essentially only one kind of brush profile for use both to transfer the mascara from the container to the face and to apply the mascara to the eye lashes. To enable improved application, it would be beneficial to provide mascara brushes having structures other than uniformly distributed bristle arrays with simple cylindrical and/or conical envelopes of circular cross-section; but the diversity of possible configurations of twisted-in-wire brushes is restricted by the requirement to trim the bristles in order to achieve desired shapes, and the difficulty of forming and positioning cutters to effect such trimming.

It has also been proposed heretofore to employ plastic brushes and combs as mascara applicators. Injection molded product suppliers are quite abundant, and the cost of a molded brush can be less than that of a twisted-in-wire brush. There nevertheless remains a need for designs affording or permitting enhanced functional versatility (e.g., thickening, lengthening and separation as well as delivery of mascara to the lashes).

SUMMARY OF THE INVENTION

The present invention in a first aspect broadly contemplates the provision of a brush for applying mascara or the like, including an elongated flexible plastic core and a multiplicity of plastic bristles projecting radially from the core, wherein the improvement comprises a shape-retaining wire disposed within and extending lengthwise of the core.

As used herein, the term "shape-retaining wire" refers to an elongated element, typically or usually made of metal and conveniently a length of conventional wire, which is substantially non-resilient so that it retains its shape. This shape-retaining wire serves as a stiffener for the plastic brush core, holding it in a stable axial configuration and thereby, for example, enabling the core and bristles to be molded of a softer (more flexible) material than would otherwise be possible.

Very advantageously, the shape-retaining wire is a bendable, substantially non-resilient wire disposed within and extending lengthwise of the core for retaining a bend or curve manually imparted to the core. Thereby, the brush may be set in a desired curved or other bent configuration by simple manipulation, and the brush will sustain itself in the shape to which it is bent.

Also, another variation is to mold the brush with a more malleable wire core that allows the possibility that the curvature of the brush may be customized by the user.

In this brush, the core and bristles are advantageously molded integrally. Conveniently or preferably, the core is molded around the wire, which may be inserted within a brush-forming mold cavity before the cavity is filled with plastic material for molding the brush.

Further in accordance with the invention, the core may have a substantially circular periphery as seen in cross-section and a distal end and a proximal end, the bristles being distributed around the core over a substantial portion of the length of the core extending from the distal end thereof, and the proximal end of the core being formed as a bristle-free shank for attachment to an applicator handle.

As an additional feature of the invention, the bristles may be arrayed in a plurality of rows extending lengthwise of the core and spaced laterally around the core periphery at unequal angular distances from each other, to achieve any of a virtually unlimited variety of configurations for such purposes as enhancing lash-thickening, lash-lengthening and/or lash-separation effects incident to mascara application.

For instance, in particular embodiments the core and bristles are molded integrally and the rows consist of first and second double rows of bristles spaced 180° apart from each other around the core periphery, first and second single rows of bristles spaced 180° apart from each other and 90° apart from the double rows around the core periphery, and third, fourth, fifth and sixth single rows of bristles each spaced 35° apart from one of the double rows and respectively interposed between the first double row and the first single row, the first single row and the second double row, the second double row and the second single row, and the second single row and the first double row.

In another aspect, the invention embraces a brush (with or without a shape-retaining wire) for applying mascara or the like, comprising an elongated plastic core and an array of plastic bristles projecting radially from the core, wherein the core and bristles are molded integrally, the core has a substantially circular periphery as seen in cross-section and a distal end and a proximal end, the bristles are distributed around the core over a substantial portion of the length of the core extending from the distal end thereof, the proximal end of the core is formed as a bristle-free shank for attachment to an applicator handle, and at least some of the bristles are disposed in a plurality of rows extending lengthwise of the core, with one or more of the following features of arrangement: bristles spaced laterally around the core periphery at unequal angular distances from each other; at least one row wherein successive bristles decrease progressively in length toward the proximal end of the core over at least a part of the length of the core; bristles distributed such that there are at least two zones, disposed in tandem lengthwise of the core, differing from each other in bristle density; and a combination of first bristles disposed in rows as aforesaid with second bristles, smaller in diameter than the first bristles, disposed in clusters.

In particular embodiments of the invention in this aspect, the lengths of the bristles in the rows may vary progressively along the length of the core such that the tips of the bristles cooperatively define a notional envelope of generally circular cross-section throughout with a diameter that initially increases, then decreases, and then increases again, in a direction from the distal end to the proximal end of the bristle array. In other embodiments, the bristle lengths of some rows may increase progressively from the distal end to the proximal end of the array, while the bristle lengths of other rows decrease progressively, imparting a complex slope or taper that changes direction around the periphery of the envelope or profile of the bristle array. Also, the bristles in the rows may be substantially closer together in a distal portion of the array than they are in a proximal portion of the array such that the bristle density is greater in the distal portion than in the proximal portion, thereby providing the brush with two zones of respectively different bristle densities disposed in tandem along the length of the core. Alternatively, the bristle array may have a central zone of a maximum bristle density and maximum envelope diameter disposed in tandem, along the length of the brush, between distal and proximal zones of a lower bristle density and decreasing envelope diameter. In a further embodiment the lengths of the bristles in one or more rows on one side of the brush decrease progressively from the proximal and distal ends of the bristle array to a central location at which the length of the bristles is at a minimum, the lengths of the bristles in one or more rows on an opposite side of the brush increase progressively from the proximal and distal ends of the bristle array to a central location at which the length of the bristles is at a maximum, and the bristles in rows intermediate these two sides are uniform in length from end to end of the brush.

Again, the lengths of the bristles in all rows may decrease progressively in a distal portion of the bristle array, toward the distal end of the core, but over the remainder of the length of the brush, the bristles in at least one row progressively decrease in length from the distal portion toward a central portion of the brush length, and then progressively increase in length toward the proximal end of the array, while an opposite variation in length occurs in at least one other row, and in at least another row the bristles are of uniform length except in the distal portion.

In yet another embodiment the array of bristles includes first bristles disposed in rows as aforesaid and second bristles, smaller in diameter than the first bristles, disposed in clusters.

Further features and advantages of the invention will be apparent from the detailed description hereinbelow set forth, together with the accompanying drawings.

DETAILED DESCRIPTION

Figure 1:
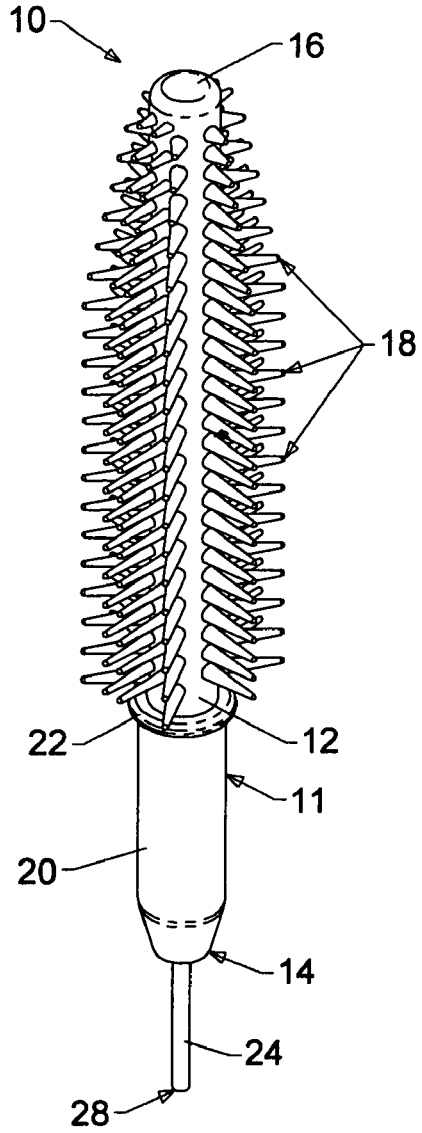
FIG. 1 is a side view of a mascara brush embodying the present invention in a particular form.
Figure 2:
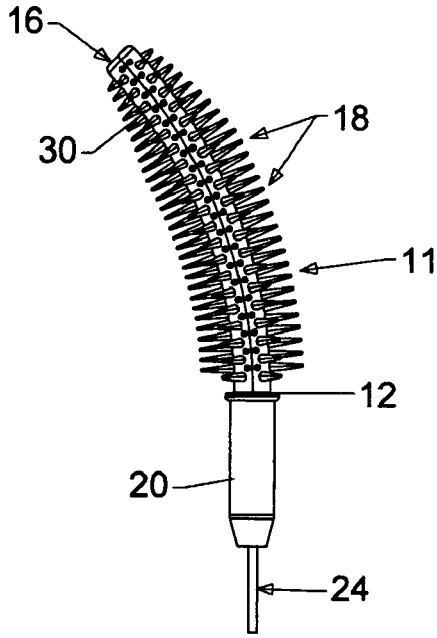
FIG. 2 is a similar view illustrating one specific curved configuration into which the brush of FIG. 1 can be retainably bent either by the user or during manufacturing.

FIGS. 1-4 illustrate a mascara brush 10 embodying the present invention. This brush includes a flexible molded plastic body 11 comprising an elongated cylindrical core 12 with an initially rectilinear long geometric axis, a proximal end 14 and a distal end 16, and a multiplicity of bristles or fibers 18 projecting laterally outwardly from the core (transversely of the core axis) over a major portion of the length of the core from its distal end toward its proximal end. The proximal end portion of the core is formed as a shank 20, being bristle-free and (in this particular embodiment) slightly larger in diameter than the remainder of the core. A small flange 22 is provided between the shank and the bristle-bearing portion of the core in this embodiment.

In common with conventional mascara brushes, the brush 10 is designed to be mounted at its proximal end in a stem (not shown) of an applicator handle (also not shown) which includes a cap (not shown) for closing the neck of a container of mascara, such that when the cap is seated on the container neck, the brush is positioned within the container in contact with mascara. When opening the container, the user grasps the cap and withdraws the brush, transporting a quantity of mascara on and between the brush bristles for application to the eyelashes. Manipulating the cap, the user brings the mascara-laden brush into contact with lashes for deposit and distribution of the mascara on the lashes.

As a particular feature of the invention, in the embodiment of FIGS. 1-4, a shape-retaining wire 24 extends longitudinally through the center of the brush core 12, from end to end thereof, essentially coaxially with the core. Thus, the distal end 26 of the wire is disposed at the distal end of the core (FIG. 4); the proximal end 28 of the wire extends through and beyond the proximal end (shank 20) of the core, so as to be received within the aforementioned stem of the applicator handle.

The wire 24, in this embodiment of the invention, is a bendable but substantially non-resilient metal wire that is self-sustaining in shape, i.e., capable of retaining its shape (whether axially rectilinear or in any curved shape into which it may be bent). Examples of wires suitable for use as the wire 24 are stainless steel wires of 0.0240, 0.0286, 0.0320 and 0.0350 inch gauge.

The core 12 and bristles 18 together constituting the body 11 are molded integrally of a suitable plastic material such as (for example) a "HYTREL®" thermoplastic polyester elastomer commercially available from DuPont, a "PELLETHANE™" thermoplastic polyurethane elastomer commercially available from Dow, or "T-BLEND™" compounded thermoplastic material composed primarily of SBS or SEBS. That is to say, by way of nonlimiting illustration, the brush may be made of a compounded thermoplastic material composed primarily of "PELLETHANE™" polyurethane elastomer (100% straight or blended), or composed primarily of "HYTREL®" polyester elastomer (100% straight or blended), or composed primarily of LDPE and/or "CHEVRON EXACT™" elastomer. The molding operation is a standard injection molding process, which is familiar to persons skilled in the art. It employs a mold cavity having the configuration of the brush body to be made; for economy of production, a single mold may have a plurality (e.g., eight) of such cavities. A wire 24 is inserted into each mold cavity before the plastic material is introduced, so that the brush body is molded over the wire.

Figure 3:
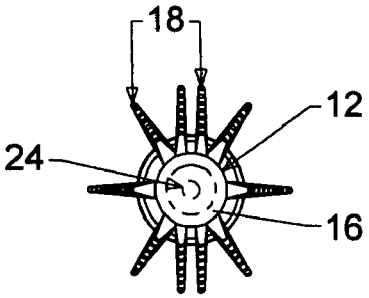
FIG. 3 is a sectional view of the brush of FIG. 1.
Figure 4:
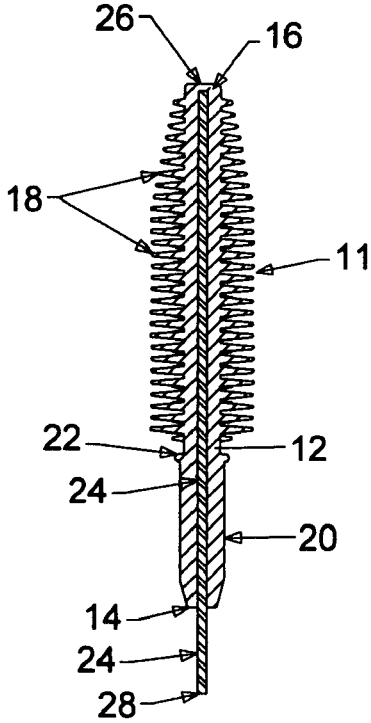
FIG. 4 is a view of the distal end of the brush of FIG. 1.
Figure 5:
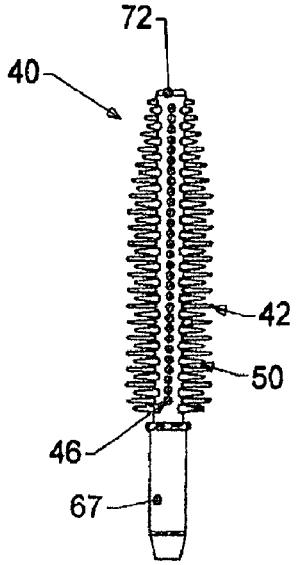
FIG. 5 is a side view of a brush lacking the shape-retaining wire of the brush of FIG. 1 but otherwise substantially identical to the FIG. 1 brush.
Figure 6:
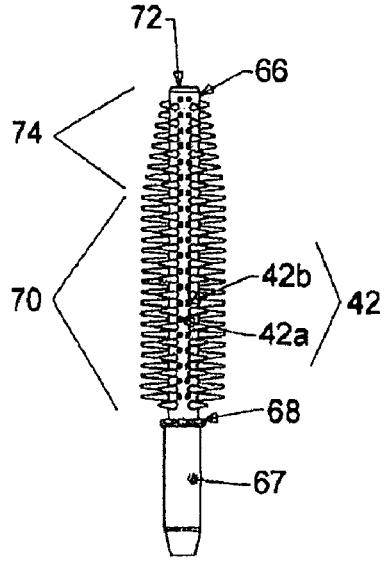
FIG. 6 is a side view of the brush of FIG. 5, rotated 90° about its long axis from the position shown in FIG. 5.
Figure 7:
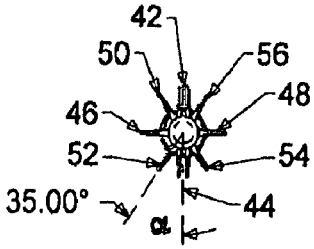
FIG. 7 is a view of the distal end of the brush of FIG. 5.
Figure 8:
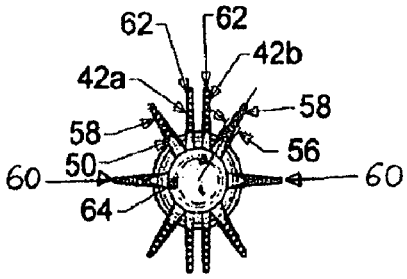
FIG. 8 is an enlarged fragmentary view of the distal end of the brush of FIG. 6.
Figure 9A:
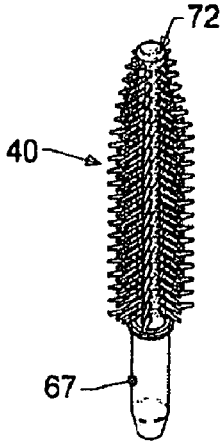
FIGS. 9A and 9B are perspective views of the brush of FIG. 5.
Figure 9B:
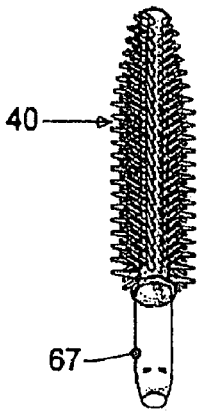

The as-molded brush body-wire unit is axially rectilinear, as shown in FIGS. 1, 3 and 4. The bendability of the wire 24, however, permits a curve to be imparted to the brush, as indicated at 30 in FIG. 2, wherein the brush is shown as bent into a curved shape. Since the wire is substantially non-resilient, it holds the curved shape into which it is bent, and retains the brush body in that shape. The curvature or straightness of the brush may be changed as desired at any time by again applying force to the brush to bend (or unbend) the wire.

The bending operation can be performed at several stages; by way of nonlimiting examples, (a) the wire can be bent before sale only (during manufacturing), (b) the wire can be bent after sale only (by the end user), or (c) the wire can be bent both before and after sale. The bending operation can be performed by several methods, including (without limitation) by machinery and by hand. Also, the wire can have various strengths; for instance, without limitation, (a) it can be strong/stiff enough so that it cannot be bent with the hands but requires machinery for bending, and once the wire is bent at the factory, it cannot be bent by the end user, or (b) it can be soft/malleable enough so that it can be bent by the hands, no machinery being needed, and it can be adjusted by the end user. In this way, the brush configuration can be easily customized and modified.

A particular advantage of molded plastic mascara brushes, as opposed to twisted-in-wire brushes, is their freedom from constraint as to envelope shape and arrangement of bristles, owing to the versatility of the molding process. Thus, bristle dimensions and arrangement (e.g. with bristles aligned in rows spaced apart by unequal distances and/or with different bristle spacing in different rows) can be designed and provided for performance of one or more functions incident to mascara application, such as lash building or thickening, lengthening and separation.

One example of a specific bristle arrangement, designed to enhance lengthening of lashes, is illustrated in the described embodiment of the invention. This bristle arrangement is best seen in FIGS. 5-9B, where it is shown in an injection molded plastic brush 40 not having a shape-retaining wire 24, although the brush 10 of FIGS. 1-4 (which includes the wire 24) has the same bristle arrangement. It will be appreciated that molded plastic mascara brushes having features of bristle dimension and/or arrangement for enhancing building or thickening, lengthening and/or separation of lashes incident to mascara application, are useful even without the presence of a shape-retaining wire and as such are embraced within the scope of the present invention in its broader aspects.

Stated with reference to FIGS. 5-9B, the molded plastic bristles or fibers of the illustrated brush 40 are arranged in a plurality of rows, viz., first and second double rows 42 and 44 spaced 180° apart from each other around the core periphery, first and second single rows 46 and 48 spaced 180° apart from each other and 90° apart from the double rows 42 and 44 around the core periphery, and third, fourth, fifth and sixth single rows 50, 52, 54 and 56 each spaced at an angle $\alpha$=35° from one of the double rows 42 and 44 and respectively interposed between the first double row 42 and the first single row 46, the first single row 46 and the second double row 44, the second double row 44 and the second single row 48, and the second single row 48 and the first double row 42. Each row extends parallel to the long axis of the core.

The shape of all the bristles is conical, and each has a free end with a radius of 0.004 inch, but they differ in base diameter and in spacing between fibers (pitch) in their respective rows as set forth in the following table, wherein the bristles or fibers 58 of the single rows 50, 52, 54 and 56 are designated Type 01 fibers, the bristles or fibers 60 of the single rows 46 and 48 are designated Type 02 fibers, and the bristles or fibers 62 of the double rows 42 and 44 are designated Type 03 fibers:

| Fiber Type | Base Diameter (in.) | Pitch (in.) |
|---|---|---|
| 01 | 0.024 | 0.047 |
| 02 | 0.024 | 0.031 |
| 03 | 0.016 | 0.047 |

The double row 42 is constituted of two bristle rows 42*a* and 42*b* spaced 0.028 inch apart on centers. The bristles of row 42*a* are parallel to those of row 42*b* and to a radius extending from the center of the core to a line halfway between rows 42*a* and 42*b*. The double row 44 is identical to double row 42 in these features of arrangement but is diametrically opposed to double row 42 around the periphery of the core. The bristles of all the other rows have long axes aligned with radii of the core.

The bristles 58, 60 and 62 and the cylindrical core 64 of the brush 40 are integrally molded of a "PELLETHANE™" thermoplastic polyurethane elastomer. The core has a bristle-bearing distal portion 66 one inch in axial length and 0.098 inch in diameter and a proximal shank portion 67 0.394 inch in axial length and 0.120 inch in diameter, separated by an integral flange 68 0.020 inch wide. The notional envelope defined by the bristle tips includes a first cylindrical portion 70 0.280 inch in diameter and 0.670 inch long, extending from the flange 68 toward the distal end 72 of the brush, and a second, frustoconical portion 74 0.330 inch long extending from the portion 70 to the distal end 72 and tapering to a minimum diameter of 0.330 inch at the brush distal end. As will be appreciated, within the envelope portion 70 the bristles all have the same length (0.091 inch) but in the portion 74 they become progressively shorter in the direction toward end 72.

Stated more broadly, in embodiments of this general type the angle $\alpha$ may be in a range of 15° to 45°, the base diameter may be in a range of 0.007 inch to 0.040 inch, and the pitch may be in a range of 0.005 inch to 0.090 inch. The double rows may be lined up with the same pitch, or staggered checkerboard with the same pitch, or staggered with different pitches and/or clustered. The double rows can be changed to single rows, multiple clusters, and multiple rows (e.g., three or four staggered rows).

This described arrangement of bristles has been found effective for performance of a lash-lengthening function. Alternative arrangements and configurations (e.g., including elimination of the conical shape of the bristle) may be used for performance of other functions such as building and separation of the lashes.

An exemplary but non-limiting variety of such alternative arrangements and configurations, within the scope of the present invention, are incorporated in the additional embodiments of the mascara brushes of the invention illustrated in FIGS. 10-32. Each of these brushes, like that of FIGS. 5-9B, includes a flexible injection-molded plastic body comprising an elongated cylindrical core 12 with an initially rectilinear long geometric axis, a proximal end 14 and a distal end 16, and a multiplicity of bristles or fibers projecting laterally outwardly from the core (transversely of the core axis) over a major portion of the length of the core from its distal end toward its proximal end, which is formed as a shank 20. The brushes of FIGS. 10-32, again like that of FIGS. 5-9B, are not shown as having a shape-retaining wire, but may also be provided with such a wire. Thus, the brushes in the embodiments of FIGS. 10-32 differ from that of FIGS. 5-9B essentially only in respect of features of arrangement and/or configuration of the bristle array.

Figure 10:
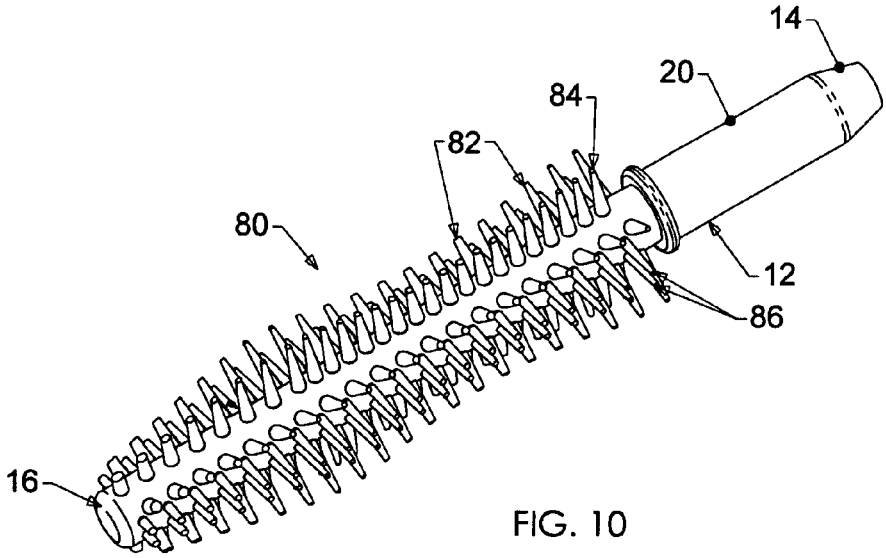
FIG. 10 is an isometric view of another embodiment of the mascara brush of the invention.
Figure 11:
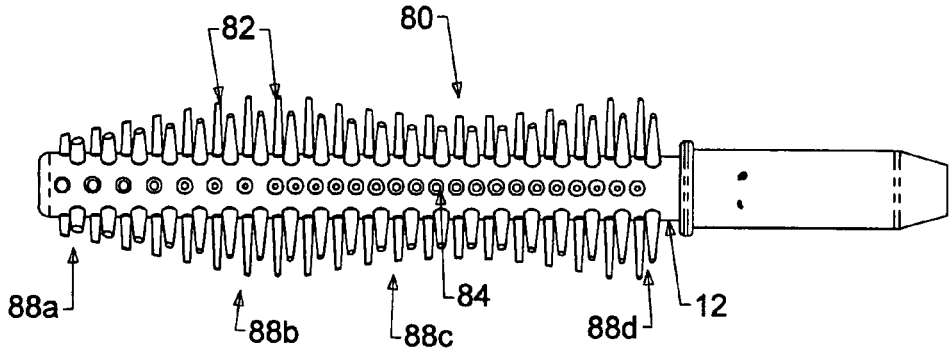
FIG. 11 is a first side view of the brush of FIG. 10.
Figure 12:
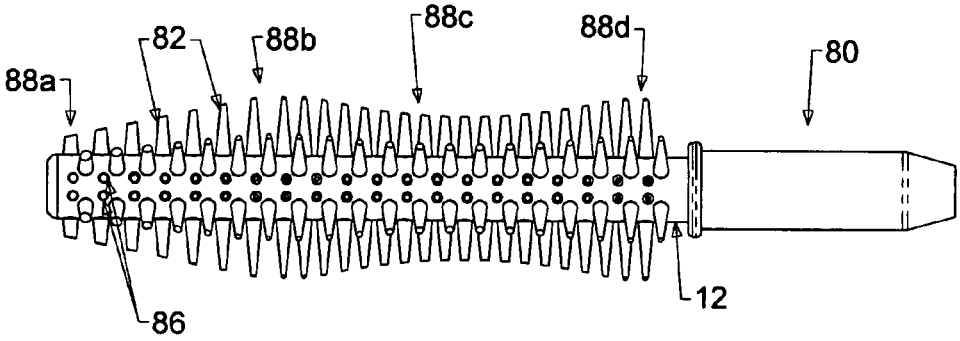
FIG. 12 is a second side view of the brush of FIG. 10, rotated 90° about its long axis from the view of FIG. 11.

Specifically, FIGS. 10-12 illustrate a brush 80 formed with a multiplicity of generally conical bristles 82 variously disposed in single rows 84 and double rows 86 extending parallel to the long axis of the core 12. The lengths of the bristles in the rows vary progressively along the length of the core, such that the tips of the bristles cooperatively define a notional envelope (e.g. of generally circular cross-section throughout) with a diameter that initially increases, then decreases, and then increases again, in a direction from the distal end to the proximal end of the bristle array. That is to say, the envelope or brush profile is narrow at a location 88*a* adjacent the distal end of the core, broader at a first intermediate location 88*b*, narrower again at a second intermediate location 88*c*, and broader again at the proximal end 88*d* of the array, while varying substantially smoothly and continuously between these minima and maxima.

Figure 13:
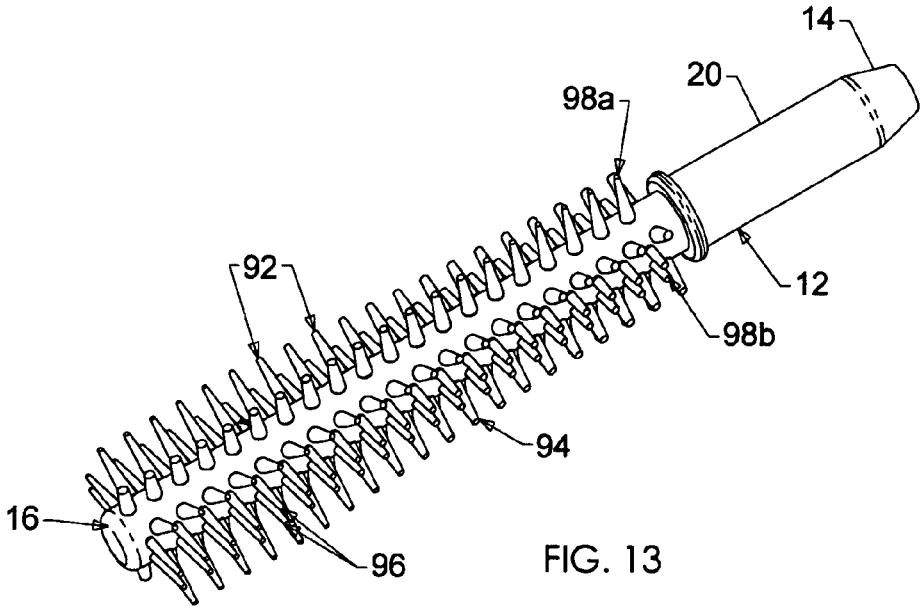
FIG. 13 is an isometric view of a further embodiment of the mascara brush of the invention.
Figure 14:
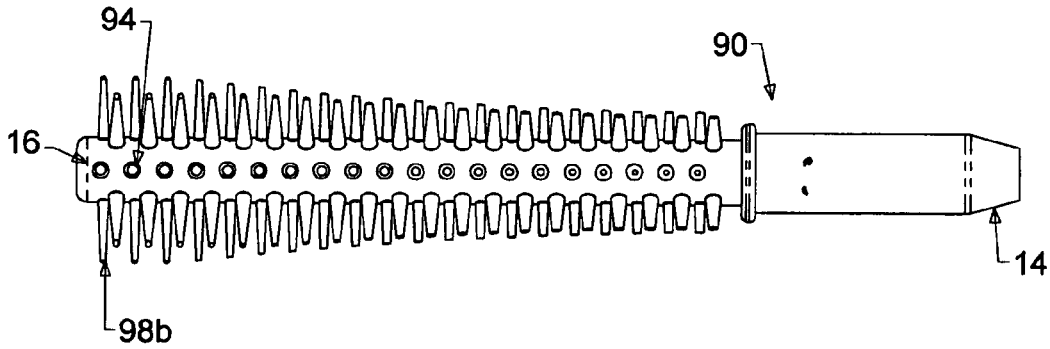
FIG. 14 is a first side view of the brush of FIG. 13.
Figure 15:
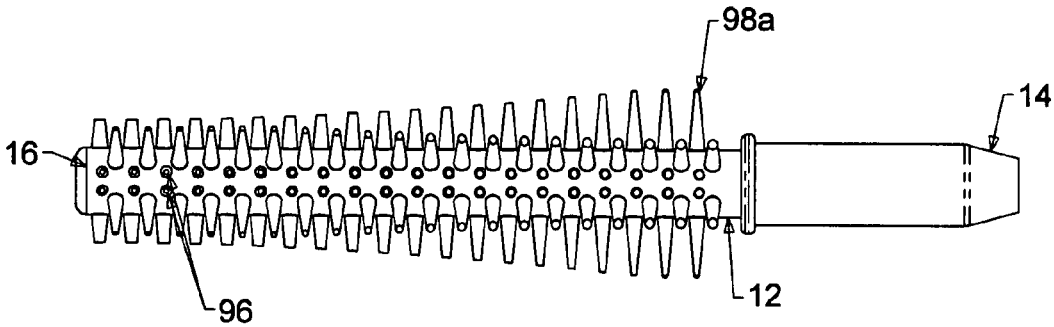
FIG. 15 is a second side view of the brush of FIG. 13, rotated 90° about its long axis from the view of FIG. 14.

The brush 90 shown in FIGS. 13-15 is formed with a multiplicity of generally conical bristles 92 again disposed in single rows 94 and double rows 96 extending parallel to the long axis of the core, with bristle lengths that vary progressively in the rows along the length of the core such that the tips of the bristles cooperatively define a notional envelope of configuration varying essentially continuously and progressively in a direction from the distal end to the proximal end of the bristle array. In this embodiment of the invention, however, the bristle lengths of some rows (e.g., row 98*a*) increase progressively from the distal end to the proximal end of the array, while the bristle lengths of other rows (e.g., row 98*b*) decrease progressively from the distal end to the proximal end, imparting a complex slope or taper that changes direction around the periphery of the envelope or profile of the bristle array.

Figure 16:
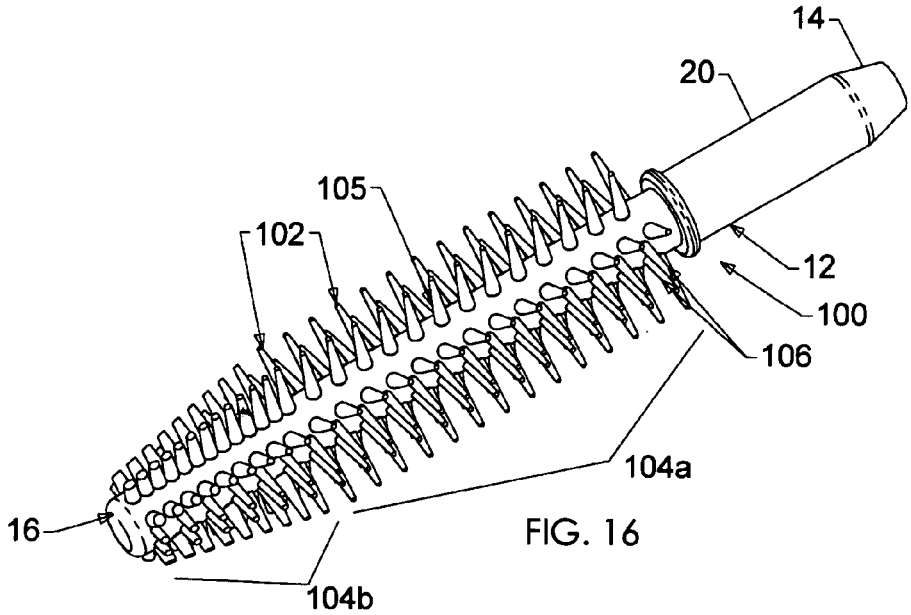
FIG. 16 is an isometric view of yet another embodiment of the mascara brush of the invention.
Figure 17:
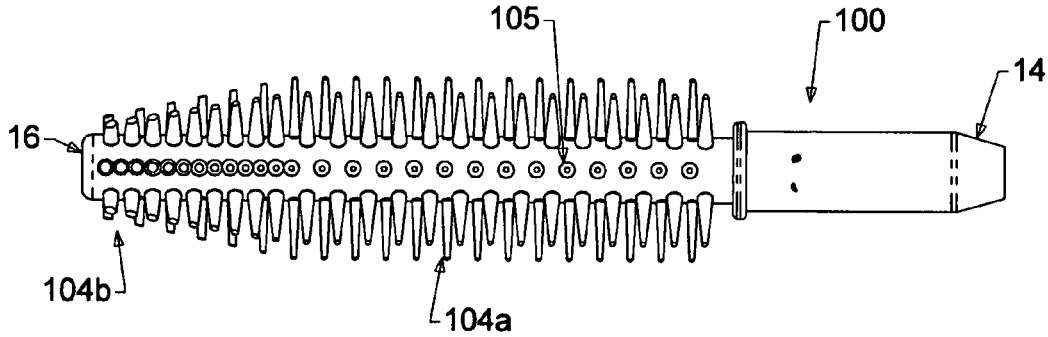
FIG. 17 is a first side view of the brush of FIG. 16.
Figure 18:
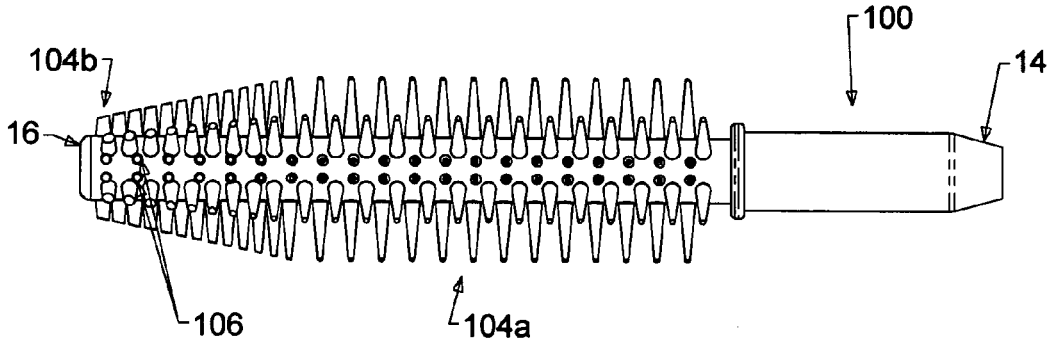
FIG. 18 is a second side view of the brush of FIG. 16, rotated 90° about its long axis from the view of FIG. 17.

In the brush 100 of FIGS. 16-18, as in some conventional mascara brushes, the notional envelope defined by the tips of the generally conical molded bristles 102 has a generally cylindrical proximal portion 104*a* and a generally conical distal portion 104*b* that tapers progressively from the cylindrical portion to the distal end of the core 12. The bristles are disposed in single rows 105 and double rows 106 both parallel to the long axis of the core; the single-row bristles are substantially closer together in the distal portion 104*b* of the array than they are in the proximal portion 104*a* of the array so that the bristle density (number of bristles per unit length of the core) is greater in the portion 104*b* than in the portion 104*a*, thereby providing the brush with two zones of respectively different bristle densities disposed in tandem along the length of the core.

Figure 19:
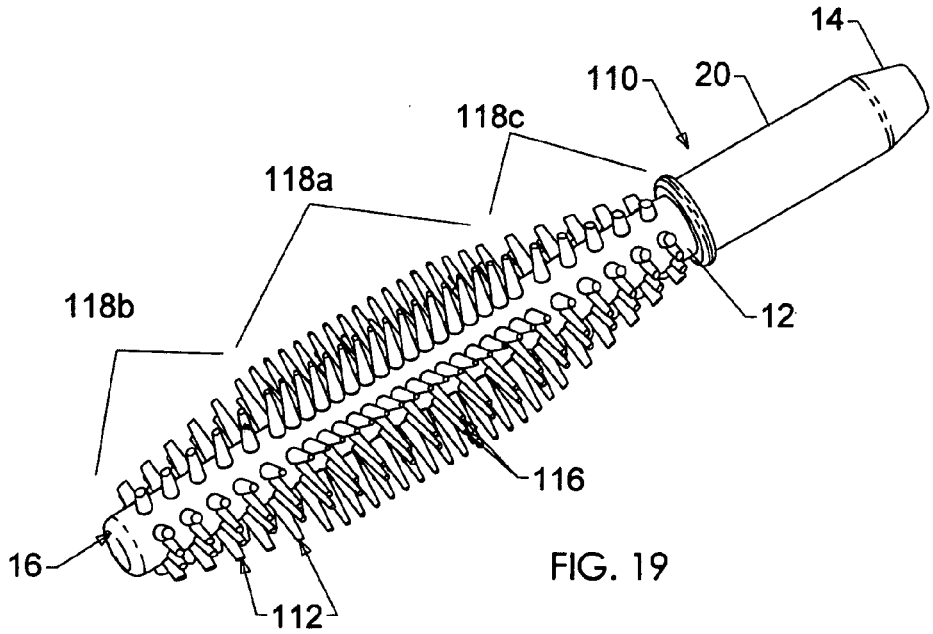
FIG. 19 is an isometric view of a still further embodiment of the mascara brush of the invention.
Figure 20:
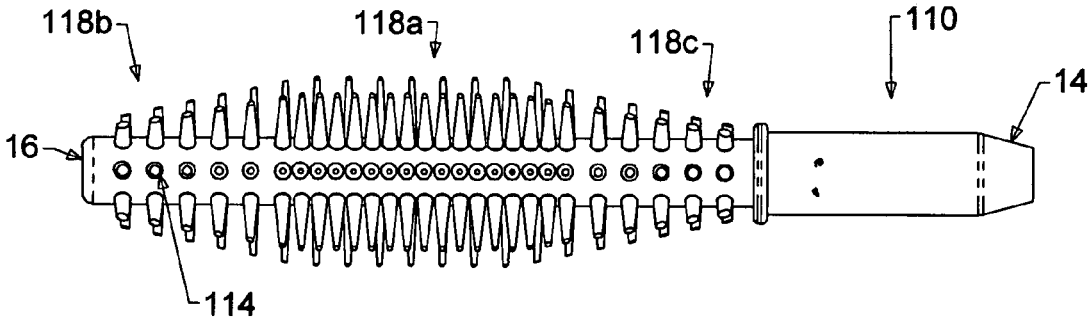
FIG. 20 is a first side view of the brush of FIG. 19.
Figure 21:
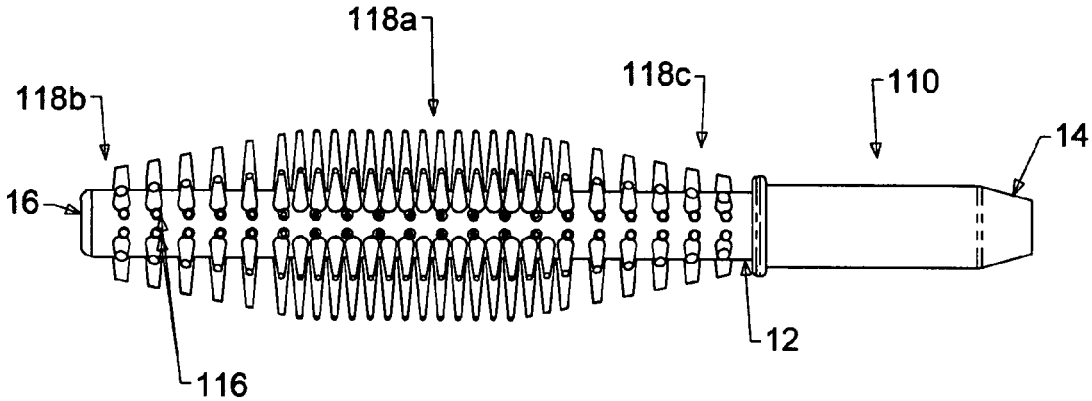
FIG. 21 is a second side view of the brush of FIG. 19, rotated 90° about its long axis from the view of FIG. 20.

The brush 110 of FIGS. 19-21 is also a zoned brush. Its bristles 112, arrayed in single rows 114 and double rows 116 both parallel to the long axis of the brush, have lengths that (in each row) decrease progressively from a central portion 118*a* of the bristle array in both proximal and distal directions, so that their tips define a notional envelope that tapers toward both the proximal and distal ends of the array. Within each single row, the bristles are closer together in the central portion 118*a* than they are in either the distal portion 118*b* or the proximal portion 118*c*; thus, the brush has a central zone (portion 118*a*) of higher bristle density and larger envelope diameter disposed between distal and proximal zones 118*b* and 118*c* of lower bristle density and decreasing envelope diameter.

Figure 22:
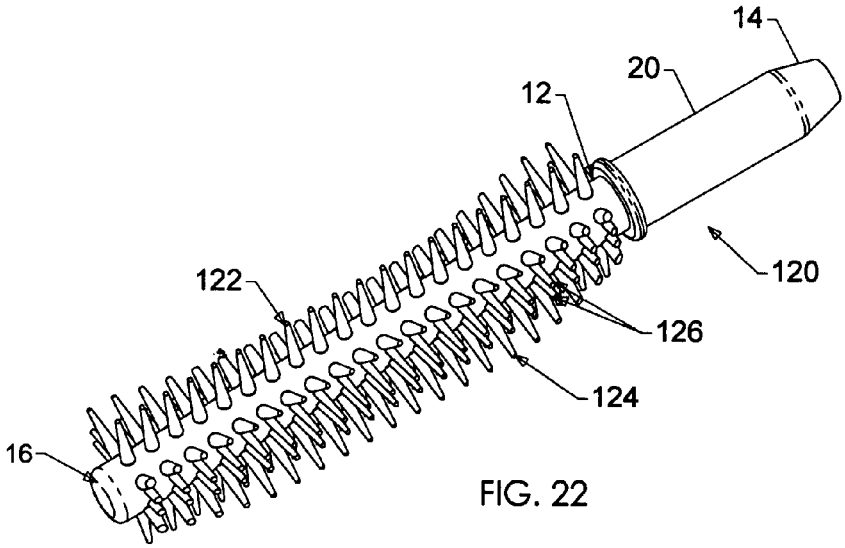
FIG. 22 is an isometric view of another embodiment of the mascara brush of the invention.
Figure 23:
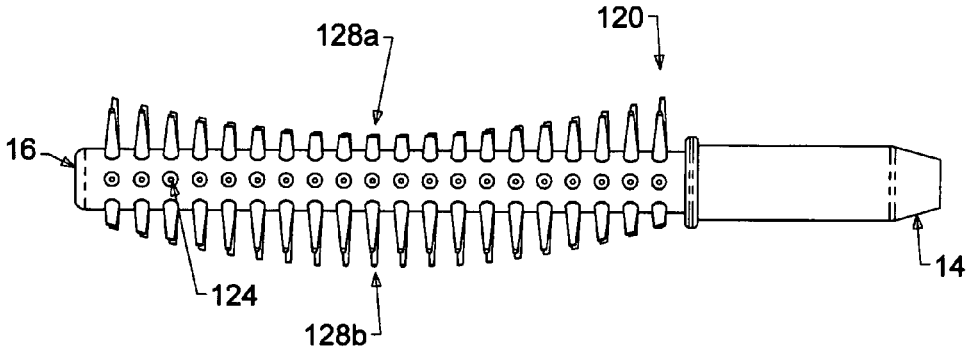
FIG. 23 is a first side view of the brush of FIG. 22.
Figure 24:
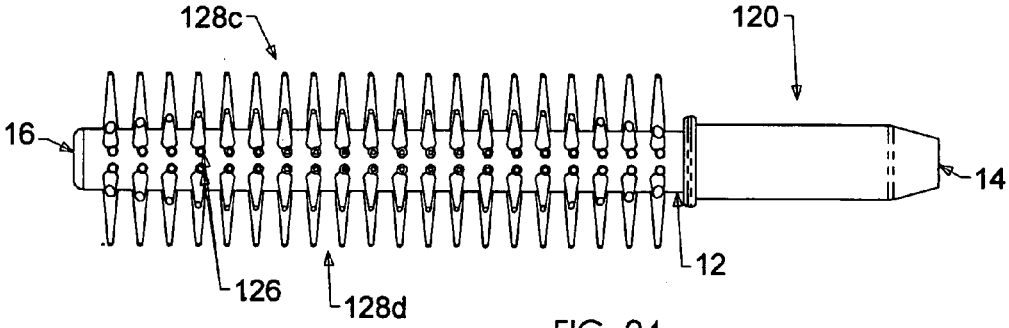
FIG. 24 is a second side view of the brush of FIG. 22, rotated 90° about its long axis from the view of FIG. 23.
Figure 25:
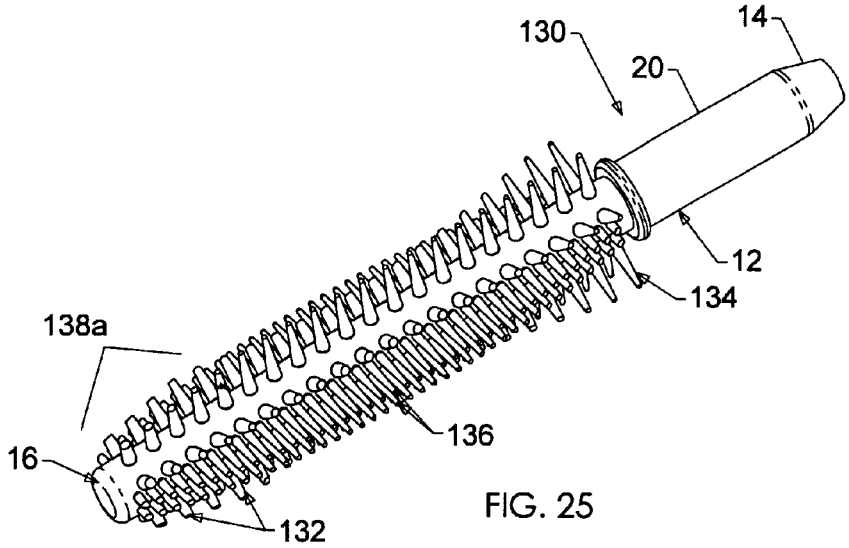
FIG. 25 is an isometric view of a further embodiment of the mascara brush of the invention.
Figure 26:
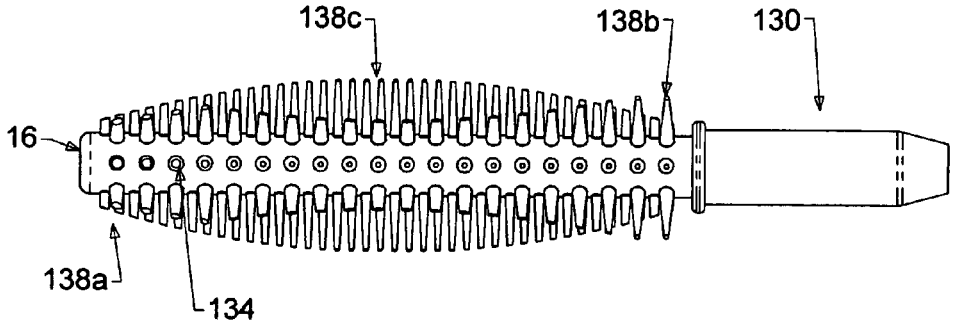
FIG. 26 is a first side view of the brush of FIG. 25.
Figure 27:
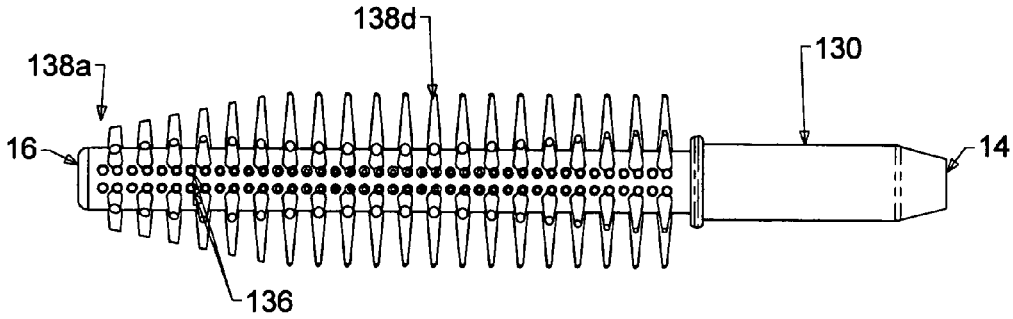
FIG. 27 is a second side view of the brush of FIG. 25, rotated 90° about its long axis from the view of FIG. 26.

In the brush 120 of FIGS. 22-24, the molded bristles 122 are again disposed in single rows 124 and double rows 126 extending lengthwise of the brush, and the spacing between bristles in any given row may be essentially uniform from end to end. In one or more rows on one side of the brush, the lengths of the bristles decrease progressively from the proximal and distal ends of the bristle array to a central location 128*a* at which the length of the bristles is at a minimum, so that the profile of the bristle array on this side of the brush is at a minimum, while in one or more rows on the other side of the brush, the lengths of the bristles increase progressively from the proximal and distal ends of the bristle array to a central location 128*b* at which the length of the bristles is at a maximum, imparting a convex profile to the latter side of the brush. The bristles in rows intermediate these two sides are uniform in length from end to end of the brush as indicated at 128*c* and 128*d*.

Figure 28:
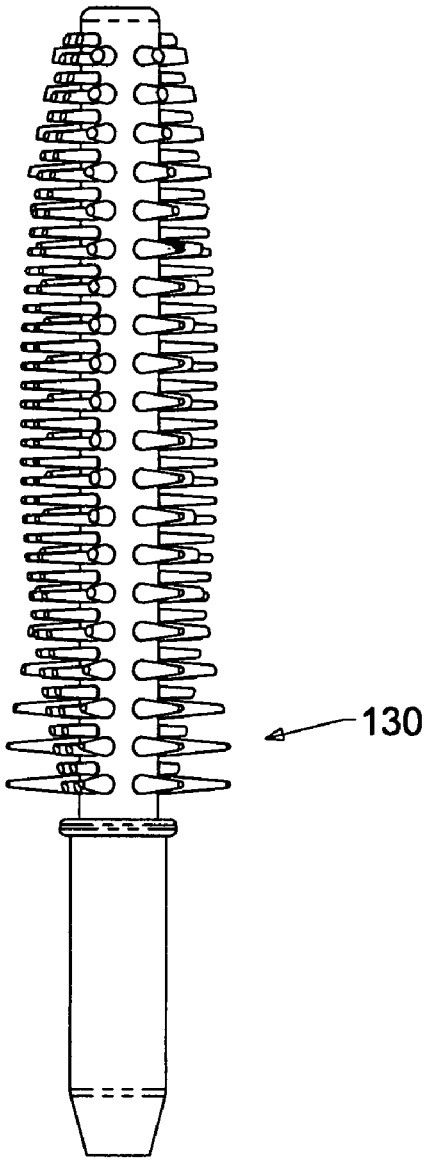
FIG. 28 is a third side view of the brush of FIG. 25, rotated 45° about its long axis from the view of FIG. 26.
Figure 29:
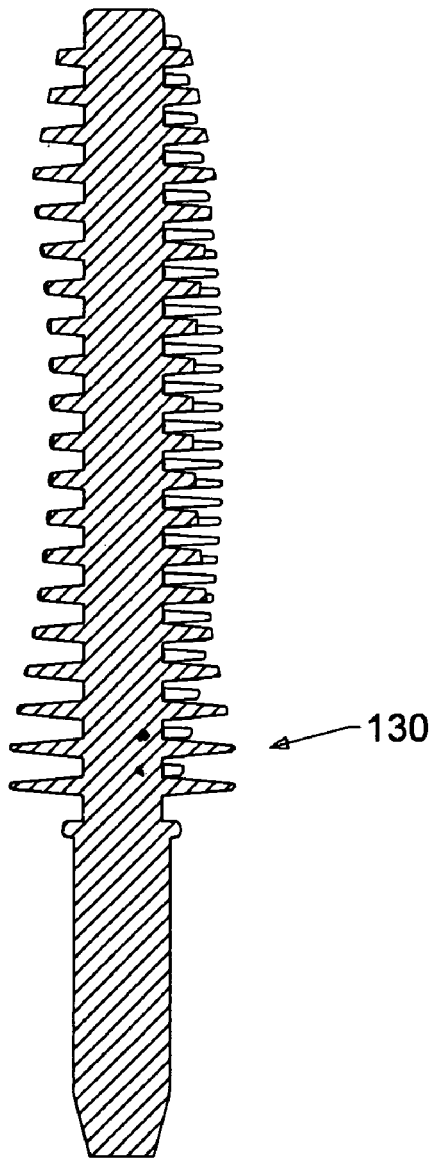
FIG. 29 is a longitudinal sectional view of the brush of FIG. 25, in the orientation of FIG. 28.

The brush 130 of FIGS. 25-29 has molded bristles 132 likewise disposed in single rows 134 and double rows 136 extending lengthwise of the brush, with essentially uniform spacing between bristles from end to end in any given row, although the double-row bristles are closer to each other than the single-row bristles. The lengths of the bristles decrease progressively in a distal portion 138*a* of the bristle array, toward the distal end of the core, but over the remainder of the length of the brush the bristle lengths in different rows vary in different ways. Thus, in row 138*b*, the bristles progressively decrease in length from portion 138*a* toward a central portion of the brush length, and then progressively increase in length toward the proximal end of the array, while an opposite variation in length occurs in row 138*c*, and in row 138*d* the bristles are of uniform length except in portion 138*a*. Thereby, a complex profile is imparted to the bristle array. As best seen in FIGS. 28 and 29, this profile may be characterized as peanut shaped.

Figure 30:
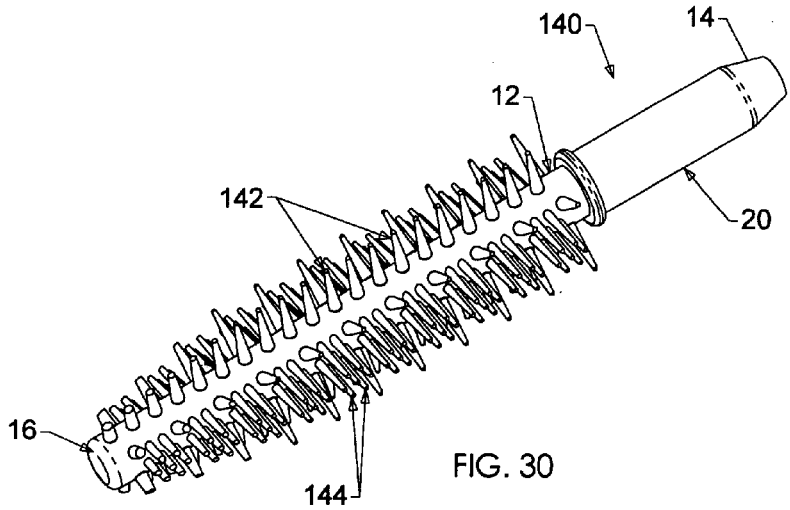
FIG. 30 is an isometric view of another embodiment of the mascara brush of the invention.
Figure 31:
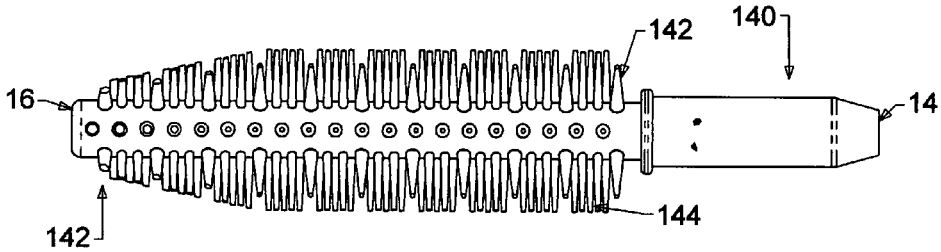
FIG. 31 is a first side view of the brush of FIG. 28.
Figure 32:
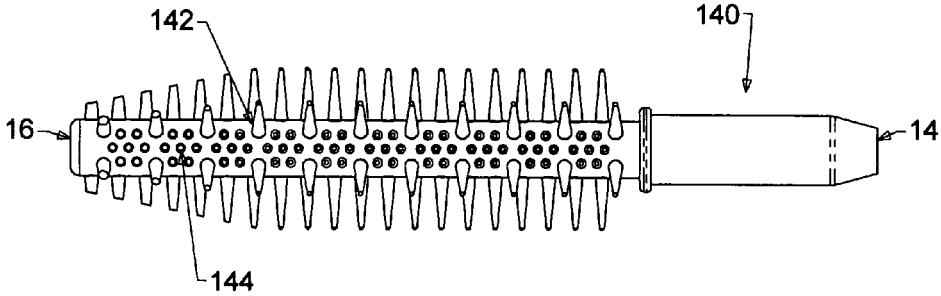
FIG. 32 is a second side view of the brush of FIG. 28, rotated 90° about its long axis from the view of FIG. 29.

FIGS. 30-32 illustrate a brush 140 including longitudinal rows of individual larger-diameter bristles 142 and longitudinal rows of clusters of smaller-diameter bristles 144 interposed between larger-diameter bristles on opposite sides of the brush. Again, the distal portion 148 of the notional envelope defined by the bristle tips tapers toward the distal end 16.

In each of these embodiments, the particular arrangement of the bristles affords specific advantages for the transport, deposition and distribution of mascara, e.g. with respect to such functions as combing or lengthening the lashes.

It is to be understood that the invention is not limited to the features and embodiments hereinabove specifically set forth, but may be carried out in other ways without departure from its spirit.

What is claimed is:

1. A brush for applying mascara, comprising:

(a) an elongated flexible plastic core having a distal end and a proximal end and (b) a multiplicity of plastic bristles projecting around the core and radially from the core, wherein the improvement comprises (c) a manually bendable, substantially non-resilient wire disposed within and extending lengthwise of the core for the entire length of the core from the distal end to the proximal end thereof and projecting through and beyond the proximal end of the core for retaining a bend or curve manually imparted to the core, the core being molded around the wire and the core and bristles being molded integrally.

2. A brush as defined in claim 1, wherein the core has a substantially circular periphery as seen in cross-section the bristles are distributed around the core over a substantial portion of the length of the core extending from the distal end thereof, and wherein the proximal end of the core is formed as a bristle-free shank for attachment to an applicator handle.

3. A brush as defined in claim 2, wherein the bristles are arrayed in a plurality of rows extending lengthwise of the core and spaced laterally around the core periphery at unequal angular distances from each other.

4. A brush as defined in claim 3, wherein said rows consist of first and second double rows of bristles spaced 180° apart from each other around the core periphery, first and second single rows of bristles spaced 180° apart from each other and 90° apart from said double rows around the core periphery, and third, fourth, fifth and sixth single rows of bristles each spaced 35° apart from one of said double rows and respectively interposed between the first double row and the first single row, the first single row and the second double row, the second double row and the second single row, and the second single row and the first double row.

5. A brush according to claim 1, wherein the wire is a stainless steel wire of 0.0240, 0.0286, 0.0320 or 0.0350 inch gauge.

6. A brush according to claim 1, formed by providing a mold cavity having a configuration of a body of the brush, the body being constituted by the core and the bristles, inserting a wire into the mold cavity before introducing a plastic material into the mold cavity, so that the brush body is molded over the wire.

7. A brush according to claim 1, comprising a plurality of rows of bristles extending lengthwise of the core and spaced laterally around the core periphery, including single rows of bristles and double rows of bristles, wherein the bristles of the single rows have a base diameter which is greater than the base diameter of the bristles of the double row.

8. A brush according to claim 1, comprising a plurality of rows of bristles extending lengthwise of the core and spaced laterally around the core periphery, including first rows of bristles and second rows of bristles, wherein the bristles of the second row are arranged with a pitch which is smaller than the pitch of the bristles of the first row.

* * * * *